US005569092A

United States Patent [19]

Rochefort

[11] Patent Number: 5,569,092

[45] Date of Patent: Oct. 29, 1996

[54] AUTOMATIC PINSETTER WITH BAFFLE AT ELEVATOR ENTRANCE

[75] Inventor: Lucien Rochefort, Beauport, Canada

[73] Assignee: Mendes Inc., Ste-Foy, Canada

[21] Appl. No.: 490,945

[22] Filed: Jun. 15, 1995

Related U.S. Application Data

[63] Continuation-in-part of Ser. No. 261,725, Jun. 17, 1994, abandoned, which is a continuation-in-part of Ser. No. 79,164, Jun. 18, 1993, abandoned.

[51] Int. Cl.[6] ..... A63D 5/08

[52] U.S. Cl. ..... 473/73; 473/94; 209/540; 414/754

[58] Field of Search ..... 473/73, 85, 93, 473/94, 97, 98, 91; 209/521, 522, 539, 540, 940; 414/754, 755, 768, 769, 770, 780

[56] References Cited

U.S. PATENT DOCUMENTS

| | | | |
|---|---|---|---|
| 2,379,148 | 6/1945 | Halek | 473/94 |
| 2,767,983 | 10/1956 | Holloway et al. | 473/97 |
| 3,417,992 | 12/1968 | Schmid | 473/97 |

FOREIGN PATENT DOCUMENTS

| | | | |
|---|---|---|---|
| 0234566 | 7/1964 | Austria | 473/91 |
| 0612902 | 1/1961 | Canada | 473/91 |

*Primary Examiner*—William M. Pierce
*Attorney, Agent, or Firm*—McCormick, Paulding & Huber

[57] ABSTRACT

In an automatic pinsetter having an elevator mechanism for receiving bowling pins seriatim at a lower entrance portion from a pit area at a rear end of a bowling alley and for transporting the same upwardly for discharge at an upper end portion, a frutso-concial baffle is provided and is suspension mounted forwardly of the elevator mechanism and above a rearwardly moving conveyor. Fallen bowling pins in indiscriminate arrangement proceed rearwardly on the conveyor beneath a bridge which obstructs rearward ball movement and passes prone bowling pins only. Left and right hand guides cooperate with the baffle to define left and right hand entry passageways for the bowling pins in rearward movement to the entrance of the elevator mechanism. The passageways are insufficient in width to accommodate the side-ways passage of bowling pins. The baffle is also free to move in any direction over a limited degree of movement. The elevator mechanism receives bowling pins on forwardly open shelves with the bowling pins in a side-ways attitude and the shelves are equally adapted for the accommodation of bowling pins with their "butt" end portions disposed leftwardly or rightwardly.

10 Claims, 13 Drawing Sheets

AUTOMATIC PINSETTER WITH BAFFLE AT ELEVATOR ENTRANCE

This is a continuation-in-part of application Ser. No. 08/261,725, entitled AUTOMATIC PINSETTER, filed Jun. 17, 1994 now abondoned, in turn a continuation-in part of application Ser. No. 08/079,164, entitled AUTOMATIC PINSETTER, filed Jun. 18, 1993, now also abondoned.

BACKGROUND OF THE INVENTION

The first step in handling bowling pins automatically is to retrieve the same from the pit area of a bowling alley and to thereafter elevate the pins for subsequent manipulation, transport forwardly and resetting or re-"spotting" in triangular bowling array on the rear end portion of the bowling alley. Various elevator mechanisms have been employed and in general such mechanisms have been successful in retrieving and elevating fallen bowling pins. A nagging problem, however, and one of long standing has been the jamming of fallen pins which are generally found in an indiscriminate and perhaps interlocking arrangement adjacent the mouth or entrance of the elevator mechanism.

It is the general object of the present invention to provide a baffle adjacent and forwardly of the mouth or entrance of an elevator mechanism which operates efficiently to prevent the jamming of fallen bowling pins as they are introduced to the mouth or entrance portion of the elevator mechanism.

A further object of the present invention resides in the provision of a baffle which exhibits the utmost simplicity in design and construction and which can be expected to enjoy a long service free life, repair and maintenance being a serious problem in automatic pinsetters employed in bowling alleys.

SUMMARY OF THE PRESENT INVENTION

In fulfillment of the foregoing objects, an elevator mechanism in an automatic pinsetter receives bowling pins seriatim at a lower entrance portion from a pit area at a rear end of a bowling alley and transports the same upwardly for discharge at an upper end portion of the mechanism. A rearwardly moving conveyer associated with the elevator mechanism is disposed in front of and extends rearwardly to the entrance thereof. The conveyer receives fallen pins from a rear end portion of the bowling alley and transports the same rearwardly in indiscriminate arrangement toward the entrance of the elevator mechanism. Upstanding left and fight hand guides co-operatively direct the bowling pins rearwardly and inwardly toward the entrance of the elevator mechanism. Disposed above the conveyer between the guides and adjacent the entrance of the elevator mechanism is a baffle constructed in accordance with the present invention.

The baffle takes a generally circular configuration in cross section and cooperates with the left and fight hand guides to define left and fight hand entry passageways on opposite sides of the baffle. The passageways are sufficiently wide for end-wise through passage of bowling pins but insufficient in width for side-wise pin passage. The result is a substantial improvement in the smooth flow of bowling pins to the entrance of the elevator and a significant reduction in jamming at the entrance of the elevator mechanism.

The baffle is preferably suspension mounted for side-to-side and front-to-rear movement and also has a shock absorber feature in its mounting arrangement. The shape of the baffle may vary but is preferably generally cone-shaped with its enlarged base disposed downwardly. More specifically, the baffle takes an upright frusto-conical configuration in preferred form and is of relatively heavy construction with regard to the weight of the bowling pins engaged thereby.

DESCRIPTION OF PREFERRED EMBODIMENT

Figure 1:
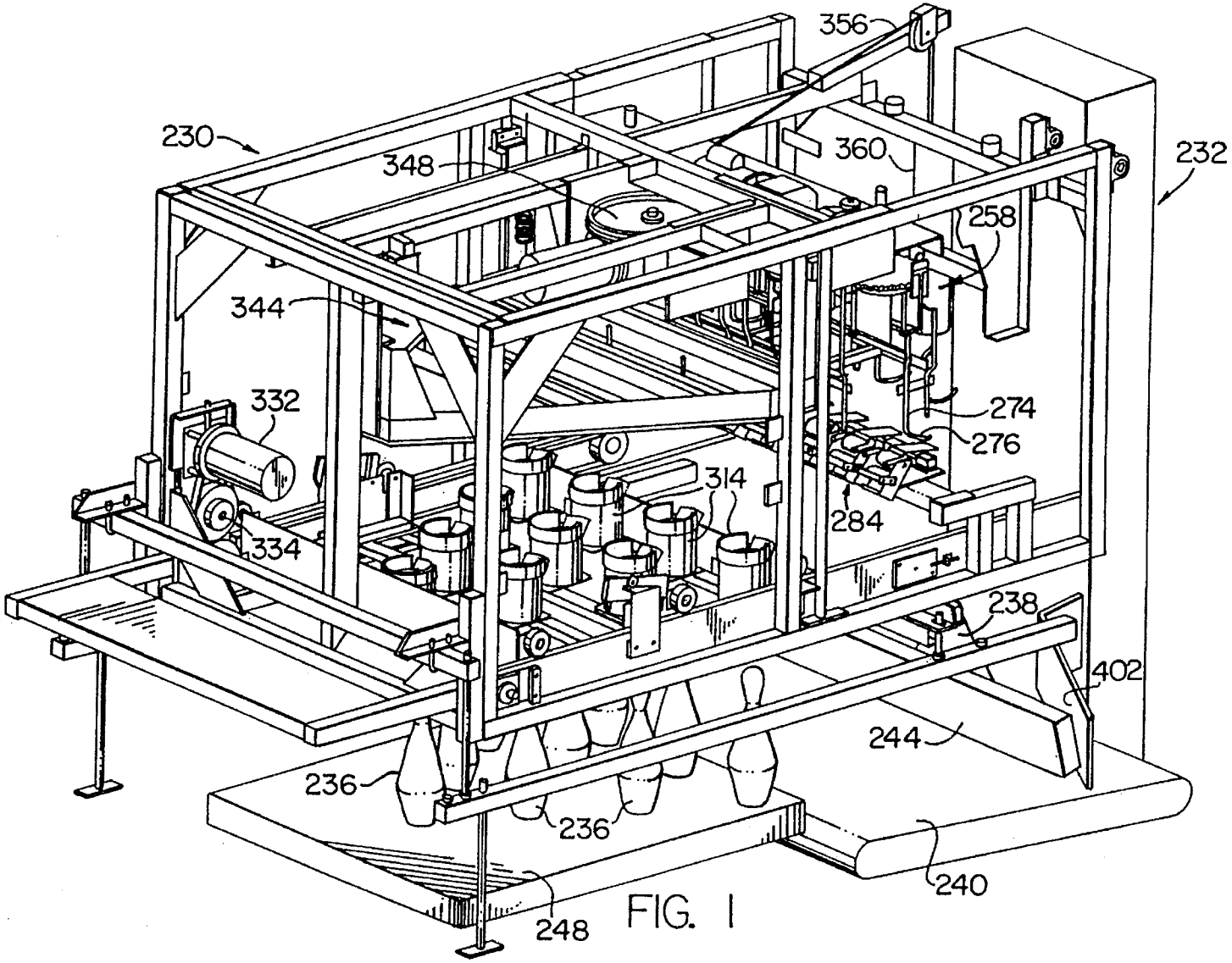
Fig. 1 is a perspective view showing an automatic pinsetter forming a second embodiment of the present invention.

The baffle of the present invention may be used with any of the various automatic pinsetters forming embodiments of the invention disclosed in the aforementioned parent applications as well as a wide variety of other automatic pinsetters and is disclosed with the automatic pinsetter of Fig. 1 et sequa only as a matter of convenience in illustration and description. The Fig. 1 et sequa pinsetter is described briefly hereinbelow and reference may be had to the aforementioned parent applications, incorporated herein by reference, for a more detailed description and illustration thereof.

The reference numeral 230 is employed to indicate generally the FIG. 1 automatic pinsetter. The pinsetter includes an elevator mechanism indicated generally at 232 in outline form in Fig. I and illustrated in more detail in a somewhat schematic perspective view in FIG. 2.

The elevator mechanism 232 is or may be conventional and includes a vertically extending series of "flights" or shelves 234,234 which are spaced apart and adapted to carry bowling pins 236 individually with the pins oriented in either direction horizontally. That is, the bowling pins 236 may have their head and "butt" ends in reverse orientation as in the case of the two bowling pins shown on upper shelves 234,234 in FIG. 2. Baffle 238 disposed in front of the elevator at its lower end portion tends to prevent jamming of bowling pins on a rearwardly moving conveyor belt 240 and thus assists in the smooth flow and delivery of the pins to the upwardly moving shelves 234,234. The baffle 238 will be described more fully hereinbelow.

The shelves 234,234 may be belt or chain driven by conventional means not shown for continuous upward movement within side frames 242,242 of the elevator. Spaced forwardly of the baffle 238 is a bridge member 244 which engages and directs bowling balls such as a ball 246 in a leftward direction in FIG. 2 across the belt 240 but which is elevated above the belt 240 a sufficient distance to allow prone bowling pins 236 to pass therebeneath. The conveyor belt 240 is also inclined leftwardly for bowling ball retrieval and has its front end portion adjacent and somewhat below a rear end portion of a bowling alley 248 so as to effectively receive all bowling pins falling therefrom.

Figure 2:
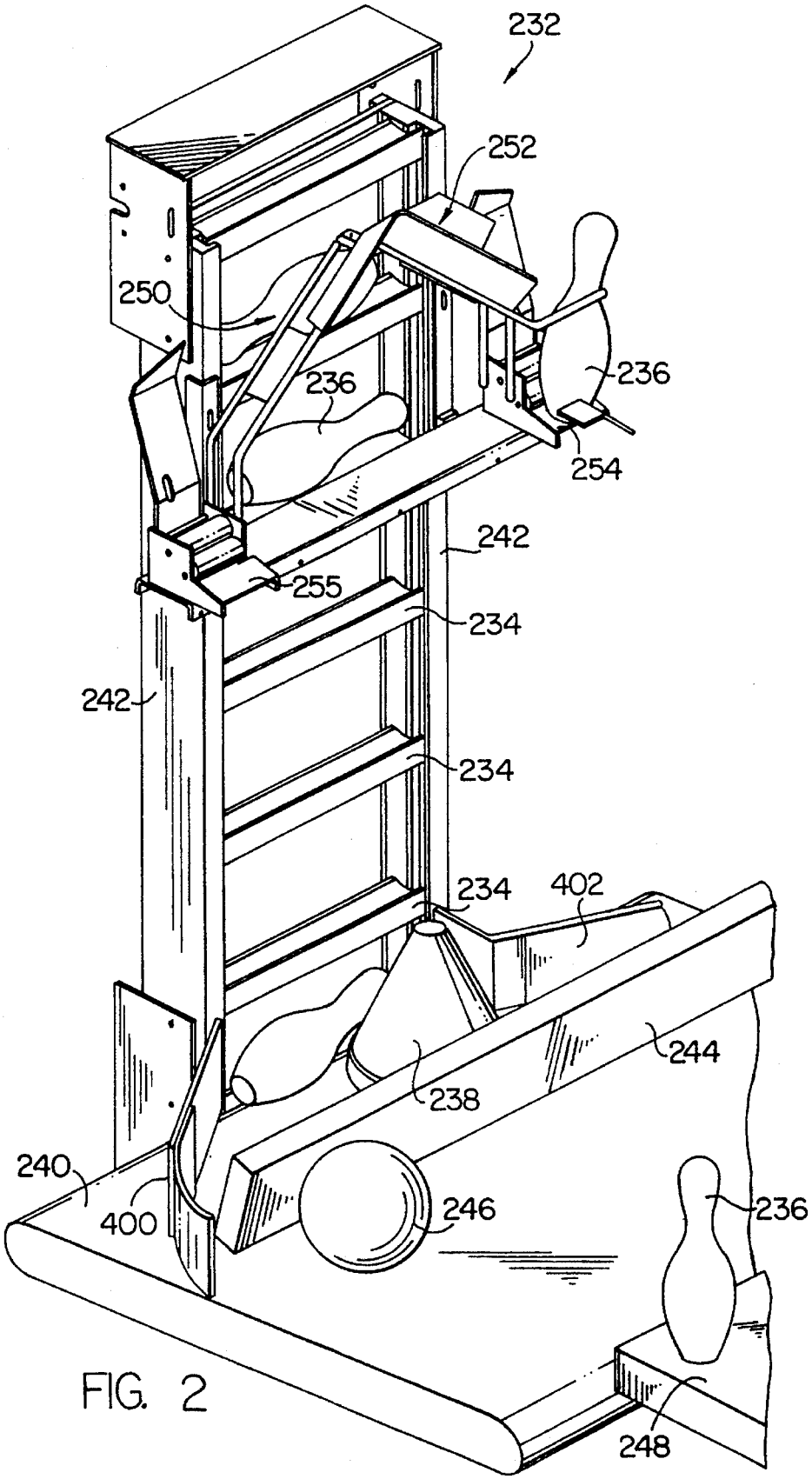
FIG. 2 is a perspective view showing an elevator mechanism of the FIG. 1 embodiment of the automatic pinsetter.

At an upper end portion of the elevator 232, pins such as the uppermost pin 236 in FIG. 2 are urged forwardly by a pusher means not shown so as to fall angularly downwardly through left or right-hand chutes indicated generally at 250,252. Chutes 250,252 accept bowling pins 236,236 and direct the same leftwardly or rightwardly depending upon the orientation of the pins on the shelves 234,234. That is, pin 236 with its head end shown at the left and its "butt" end at the right, due to the weight of the "butt" end exceeding the weight of the head end, will fall downwardly to the right in the chute 252 onto a platform 254 thus arriving in an upright attitude. The next succeeding pin 236 on shelf 234 beneath the top pin, due to the weight of its "butt" end, will fall down the left-hand chute 250 so as to arrive in an upright position as shown by the pin 236 on platform 255 at a lower end portion of the chute 250.

Figure 3:
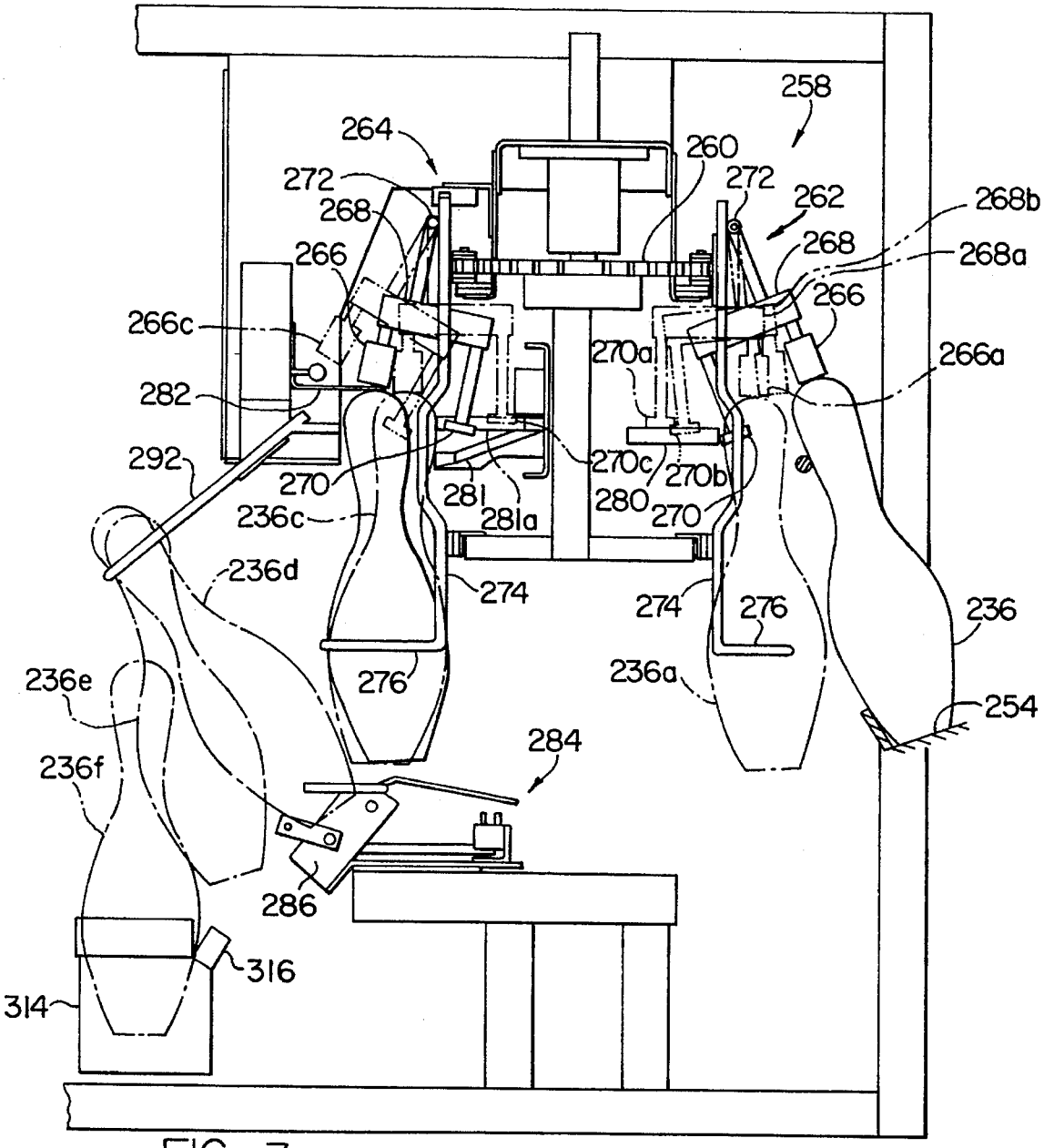
FIG. 3 is an enlarged fragmentary view in elevation showing a portion of a transfer mechanism including a conveyor, a discharge device for removing bowling pins from the conveyor, a holder forming a part of a collator, and an upwardly open cradle for receiving a bowling pin.

In FIG. 3, a bowling pin 236 is shown on the right-hand platform 254 in position to be picked-up by a bowling pin handling device indicated generally at 258. The handling device 258 includes a conveyor which may take a chain or belt form at 260 and which includes a loading or pick-up run 262 which extends horizontally across the pinsetter. A discharge run 264 also extends horizontally across the pinsetter but moves in an opposite direction with respect to the run 262. The conveyor 260 may be operated continuously by power drive means such as a DC motor not shown and carries a plurality of magnetic means in the form of permanent magnets 266,266 mounted on a similar plurality of carrier bars 268,268 each of which also carries a depending cam follower 270. The carrier bars 268 are pivotally mounted as at 272 with the magnets 266 and cams 270 depending therefrom in spaced relationship.

A plurality of permanent magnets 266, carrier bars and cams are similarly mounted in spaced relationship and progress along both the loading and discharge runs of the conveyor as illustrated in FIG. 3. Depending pin guide elements 274 are also provided and each permanent magnet device has an associated guide element which may take the form of a wire or rod which extends downwardly and which has a generally U-shaped portion 276 at a lower end to partially envelop and guide a bowling pin 236 held by a magnet 266. Especially on pick-up of a bowling pin there may tend to be a degree of swaying of the pin which might result in an inadvertent dislodgment from its magnet. Guiding of the pin as well as retention of the same in a vertical attitude is insured by the members 274,276.

The bar 268, magnet 266 and cam 270 shown in full line in FIG. 3 and with the magnet 266 in engagement with the head of pin 236 on the platform 254 is illustrated in the process of picking-up or "loading" the pin 236 onto the conveyor. The left-hand broken line cam follower **270*a* in FIG. 3, shown in a vertical position, is associated with a cam 280 and is shown passing above the cam 280 with a permanent magnet 266*a* attached to a bowling pin 236*a* illustrated behind bowling pin 236. The weight of the bowling pin 236*a* on the assembly comprising the magnet 266*a*, its cross bar 268*a* and cam follower 270*a* causes the follower to ride over the top of cam 280 with a small biasing force in the mounting of the bar 268*a* overcome by the weight of the pin 236*a*. That is, a small biasing spring or the like may be provided adjacent the pivot 272 to cause the permanent magnets and supporting bars to take an intermediate position such as illustrated at 268*b* for the bar, 266*b* for the magnet and 270*b* for the cam follower. In the intermediate position shown, cam follower 270*b* will obviously engage a rear portion of the cam 280 as the conveyor 260 moves toward the viewer in FIG. 3 and an incline, not shown, on a rear portion of the cam will cause the follower to move to the position of the full line follower 270. This results in the magnet 266 being pivoted to its full line position shown in FIG. 3 for pick-up of the bowling pin 236** as aforesaid.

The bowling pin 236, having been picked-up or loaded onto the conveyor 260 as described, proceeds forwardly and thence leftwardly to the position shown at the left-hand position of FIG. 3 in broken line at **236*c*. A cam shown in an inoperative and lower position at 281 forms a part of a discharge device and is moveable upwardly to a broken line position at 281*a*. At position 281*a* the cam engages the cam follower shown in broken line at 270*c* and causes the same to pivot to the full line position 270. This in turn causes the permanent magnet to move upwardly and leftwardly to the full line position 266 and a fixed knife-like separator element 282 enters the crevice thus provided between the head of bowling pin 236 and permanent magnet 266 to dislodge the bowling pin from the magnet. Continued upward and leftward movement of the permanent magnet to the broken line position 266c insures a clean and effective separation of the bowling pin from its supporting magnet 266**.

Figure 4:
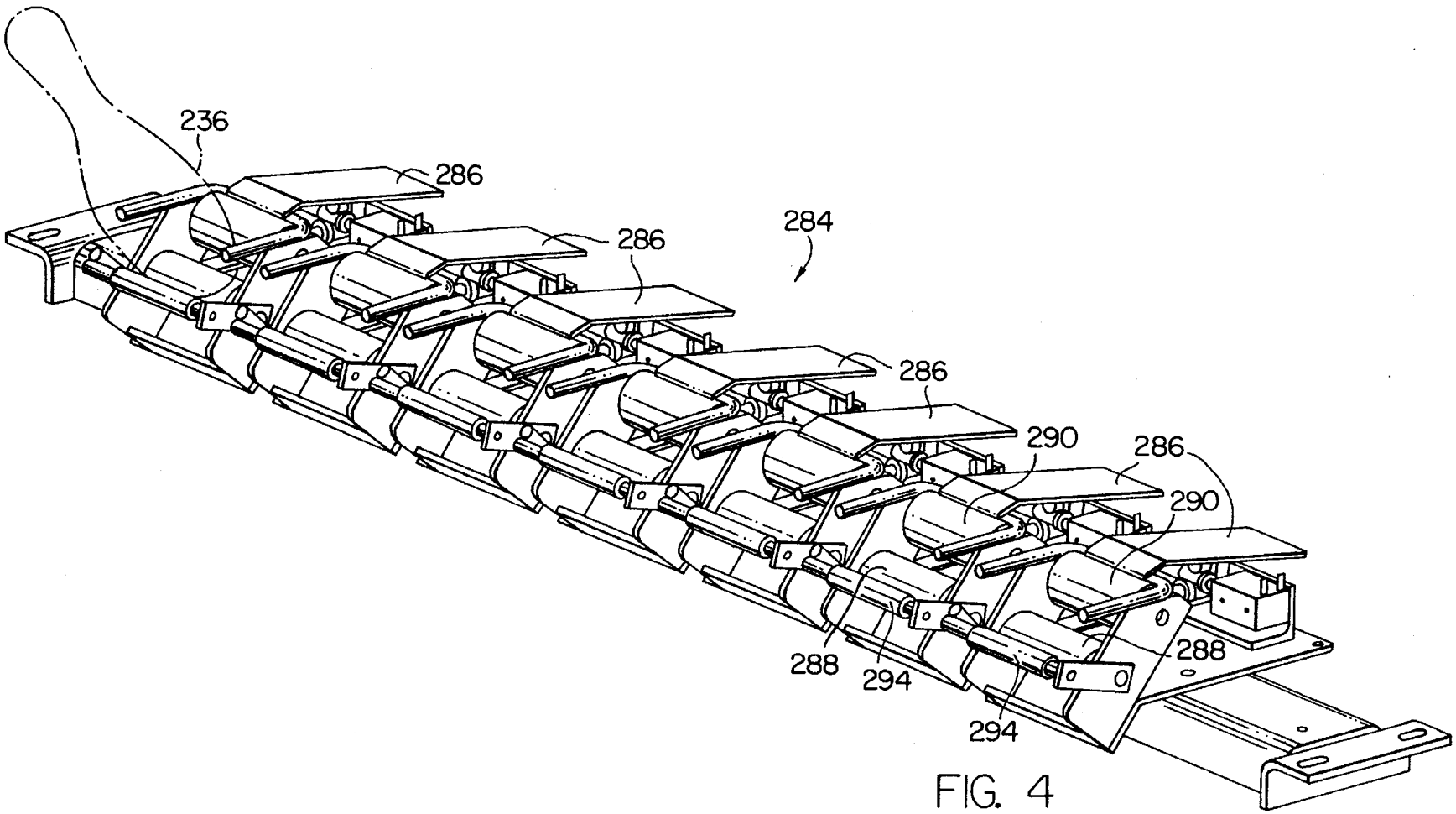
FIG. 4 is a perspective view showing a series of pin holders forming the collator of the present invention.

Referring now to FIG. 4, a collator for the bowling pins discharged from the conveyor and handling device 258 is indicated generally at 284 and preferably comprises a series of seven (7) bowling pin holders 286,286 as illustrated. The pin holders 286,286 are arranged horizontally and laterally in series in the pinsetter as illustrated in Fig. I and preferably have associated therewith a series of seven (7) discharge devices as described above. That is, bowling pins 236 are discharged from the conveyor 260 by the dislodgment of the pins from the permanent magnets at seven (7) stations spaced apart along the conveyor and extending across the automatic pinsetter. Substantially more than seven (7) permanent magnets may of course be provided on the conveyor so as to provide for a ready supply of bowling pins for discharge to the pin holders 286,286 of the collator 284. Pins may be discharged individually or two or more or as many as seven pins may be discharged substantially in unison from the conveyor 260 to the collator 284. As will be explained more fully hereinbelow, three (3) pins are collected or collated by the collator 284 at the center portion of the collator in one discharge operation and seven (7) bowling pins are collected or collated in the collator 284 in another discharge operation. Control may of course be exercised by an appropriate controller operating to move cams 281,281 from their full line inoperative positions to their upper and broken line operative positions.

Reverting now to FIG. 3, the full line pin 236 shown at the left-hand side of the view falls from its magnet 236 at the urging of the knife-like element 282 into a pin holder 286 disposed therebeneath. Each pin holder 286 comprises front and rear rollers 288,290 spaced and arranged at an angle so as to allow the bowling pin to swing downwardly and leftwardly in FIG. 3 for retention by a bale or hook 292. That is, bale or hook 292 receives and holds an upper end portion of a bowling pin with a lower or "butt" end portion thereof engaging the rollers 288,290 in a pin holder. The lower end portion of the bowling pin such as broken line pin **236*d* is restrained by a small gate roller 294 so as not to fall out of its pin holder. Thus, it will be readily understood that three (3) pins can be held in the three centermost pin holders 286,286 or seven (7) pins may be held in the seven pin holders 286,286**.

Figure 5:
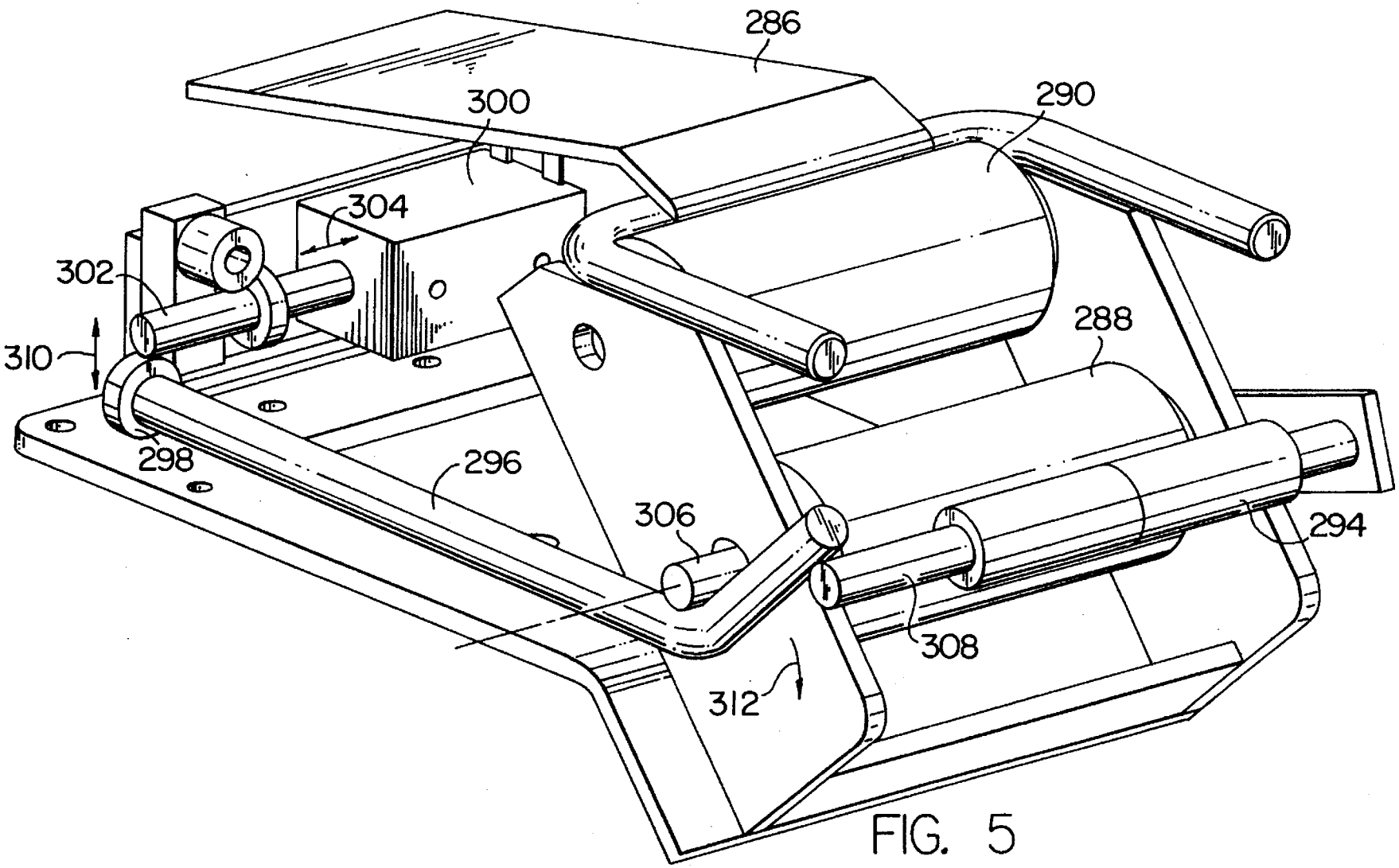
FIG. 5 is an enlarged perspective view of a single pin holder of FIG. 4.

Release of the bowling pins from their holders will best be understood with reference to FIG. 5. An actuating arm 296 has a rear end portion provided with a small counterweight 298 and has an associated solenoid 300 with a plunger 302 moveable toward and away from a position above the counterweight 298 as illustrated by arrows 304. The actuating arm 296 at its front end portion, is welded or otherwise attached to shaft 306 associated with the front and lower roller 288 of the pin holder 286 and shaft 308 associated with gate roller 294 which retains the bowling pin in the pin holder. The weight of the bowling pin against the roller 294 will tend to pivot the actuating arm 296 upwardly at a rear end position as illustrated by arrow 310. With the plunger 302 in the position shown, however, the actuating arm is prevented from so moving and the roller 294 is held in position to secure the lower end portion of a bowling pin **236*d* in the pin holder. On withdrawal of the plunger 302 rightwardly in FIG. 5, the rear end portion of the actuating arm 296 will pivot upwardly with the shaft 306 turning in a clockwise direction in FIG. 5 whereby to similarly rotate the roller 288 and to swing the gate roller 294 in the direction shown by the arrow 312 downwardly and forwardly thus releasing the lower end portion of the bowling pin. The slight rotation of the roller 288 will also tend to cause the lower end portion of the bowling pin to fall from the pin holder 286 as better illustrated at 236*e* in broken line form in FIG. 3. When the lower end portion of the bowling pin has been released by the roller 294 the counterweight 298 returns the actuating arm 296 and the roller 294 to the position shown in FIG. 5. The plunger 302 is then again returned to the left-hand or extended position shown retaining counterweight 298, actuating arm 296, and roller 294 in the full line position of FIG. 5**.

Returning now to FIG. 3, the bowling pin shown in broken line at **236*e*, having been released from the pin holder 286, tends to swing in a clockwise direction about its upper end portion at the urging of gravity whereby to assume a substantially vertical position as illustrated at 236*f* with its "butt" end portion deposited in an upwardly open cradle 314. A small guide member 316 at a rear end portion of the cradle may assist in directing the lower or "butt" end portion of the bowling pin into the cradle in its descent from an associated pin holder 286**.

FIGS. 6 through 10 illustrate a carrier and a cradle assembly also forming a part of the transfer device of the present invention and which is expandable and collapsible horizontally and in the longitudinal direction of the automatic pinsetter whereby to contribute importantly to the compact longitudinal configuration of the pinsetter. In FIG. 5 ten (10) upwardly open cradles 314,314 are provided for a conventional triangular bowling array with ten (10) bowling pins. The cradles are so shown in FIG. 5 for removal of bowling pins from the carrier by a pinsetting mechanism and for the subsequent deposit of the pins on the bowling alley therebeneath following horizontal withdrawal of the carrier.

Carrier elements in the form of horizontal and laterally extending slats 318,320,322,324 are provided for supporting the cradles 314,314. The slat 318 supports the front or "lead" cradle 314, while the slat 320 supports the second row of two (2) cradles, the slat 322 the third row of three (3) cradles and the slat 324 the fourth and rearwardmost row of four (4) cradles. The slats 318 and 322 are connected together longitudinally by connector elements 326 as are the slats 320 and 324 by longitudinal connector elements 328. Further, the cradles 314,314 are mounted on small platforms 330,330 which project laterally from their respective slats so as to offset the cradles laterally from the slats in opposite directions on adjacent slats. That is, the cradle 314 on the slat 318 is offset laterally rearwardly relative to its slat with two (2) cradles 314,314 on the slat 320 offset laterally forwardly. The three (3) cradles 314, on the slat 322 are offset laterally rearwardly with the four (4) cradles 314, on the slat 324 offset forwardly. Due to the offset of the cradles and the corresponding conventional spacing of bowling pins in a triangular array, the cradles on the slats 318 and 320 can be aligned in a series or row of three (3) cradles extending laterally of the automatic pinsetter. Similarly, the cradles on the slats 322 and 324 can be aligned in a series or row of seven (7) cradles extending laterally of the pinsetter. The manner in which this is accomplished is described hereinbelow.

Figure 6:
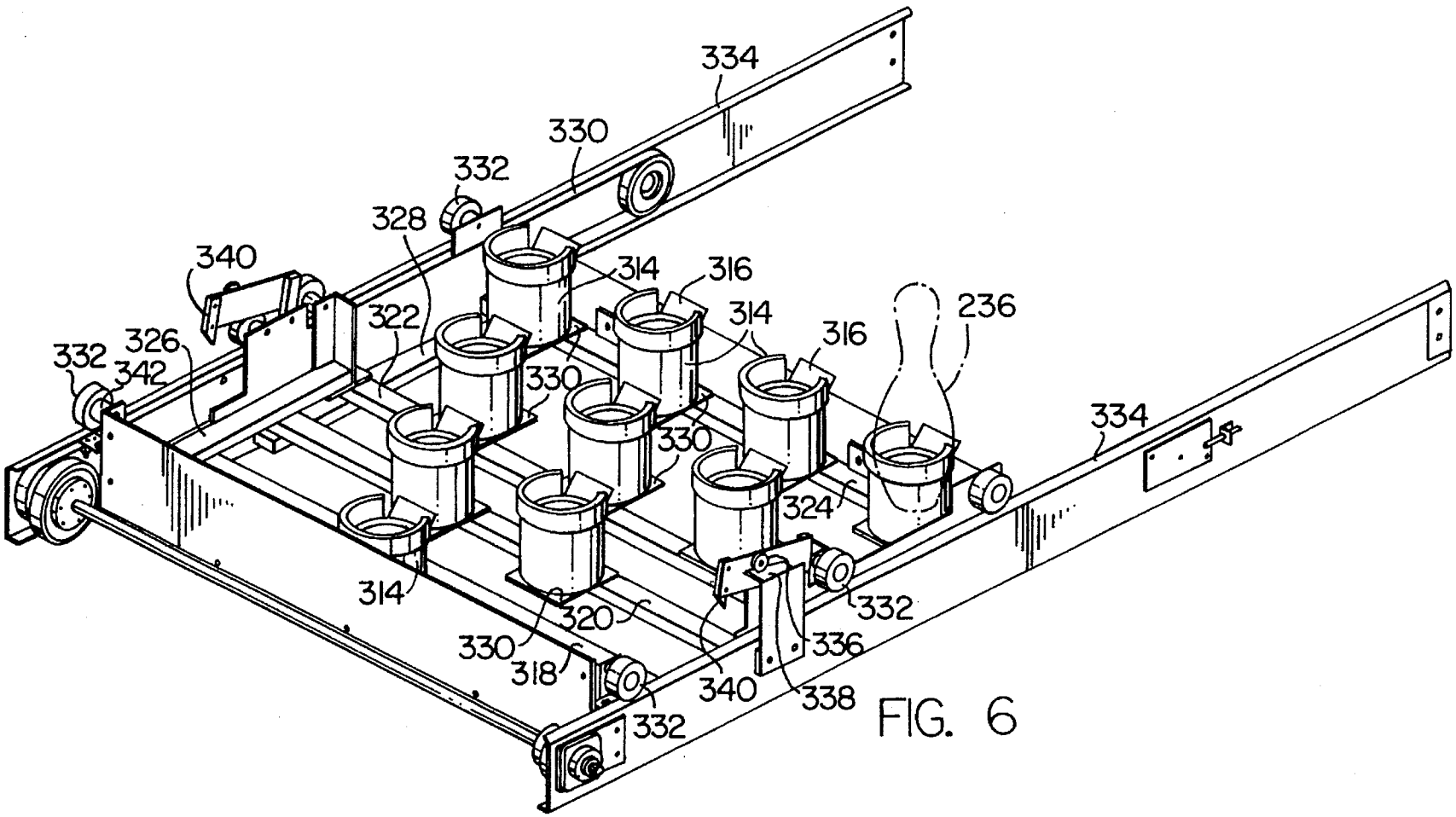
FIG. 6 is a fragmentary perspective view of a carrier forming a part of the transfer mechanism of the pinsetter and including a plurality of cradles on the carrier in an expanded and a conventional triangle bowling array.
Figure 7:
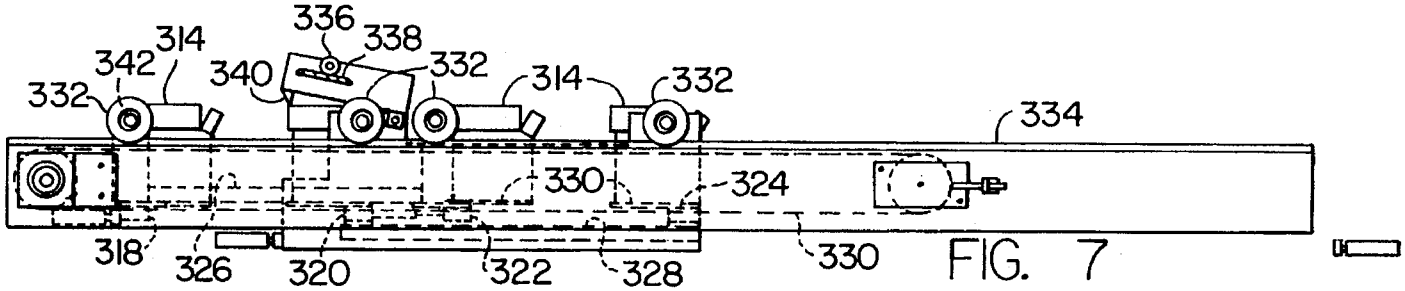
FIG. 7 is a side view of the carrier and cradles of FIG. 6 with the carrier and cradles in expanded condition and with the cradles in triangular bowling array.

Referring now to FIGS. 6 and 7, it will be observed that chain or belt drives 330 extend horizontally with upper and lower runs on each side of the carrier. The belts or chains 330 may be operated by a suitable DC electric motor 332 in FIG. 1 through appropriate gearing 334. With a forward end portion of the carrier adjacent the slat 318 attached to a lower run of belt or chain 330, and with the lower run moving rearwardly as in FIG. 8, the slats 318 and 322 will be moved rearwardly as illustrated whereby to bring the slats 318 and 320 in close proximity to each other and the slats 322 and 324 similarly in close proximity. In this arrangement of the slats, the cradles 314 on the slats 318 and 320 are aligned laterally in a series of three as illustrated in FIG. 10 and the cradles on the slats 322 and 324 are aligned in a series of seven cradles.

Figure 8:
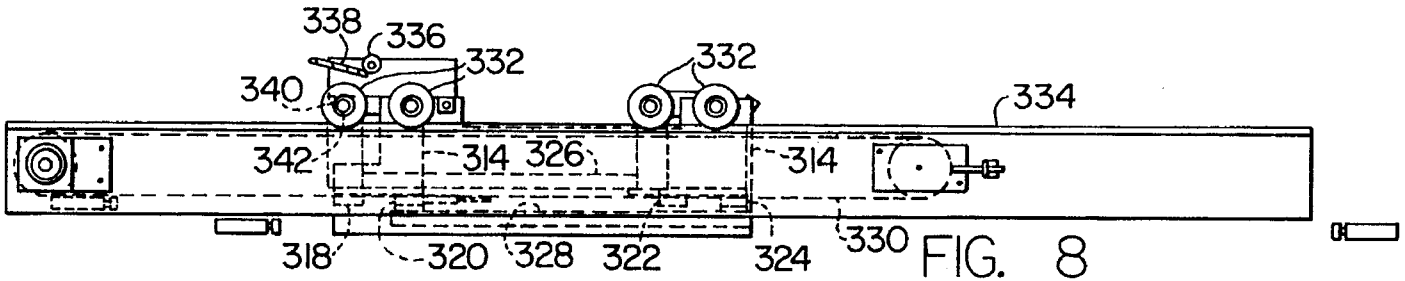
FIG. 8 is a view similar to FIG. 7 but with the cradles and carrier in an intermediate position.
Figure 9:
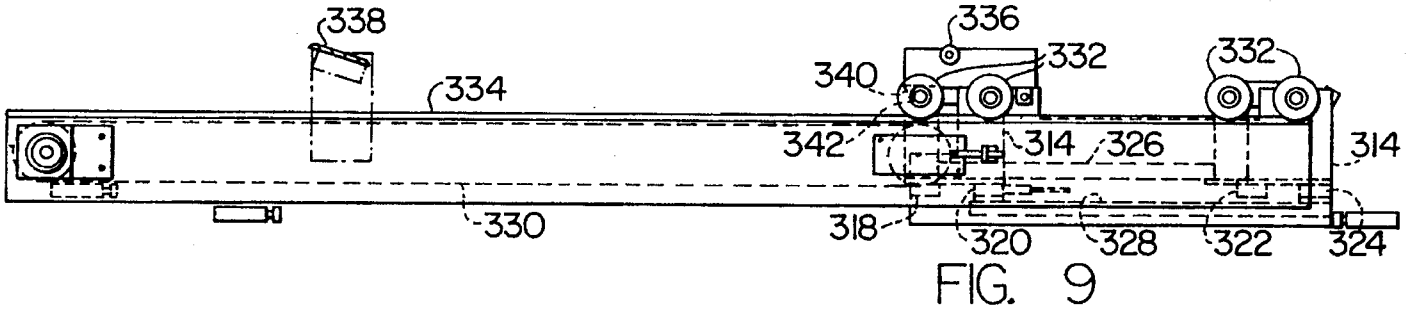
FIG. 9 is a view similar to FIG. 8 but with the carrier and cradles in a contracted position with the cradles in first and second linear series or rows.
Figure 10:
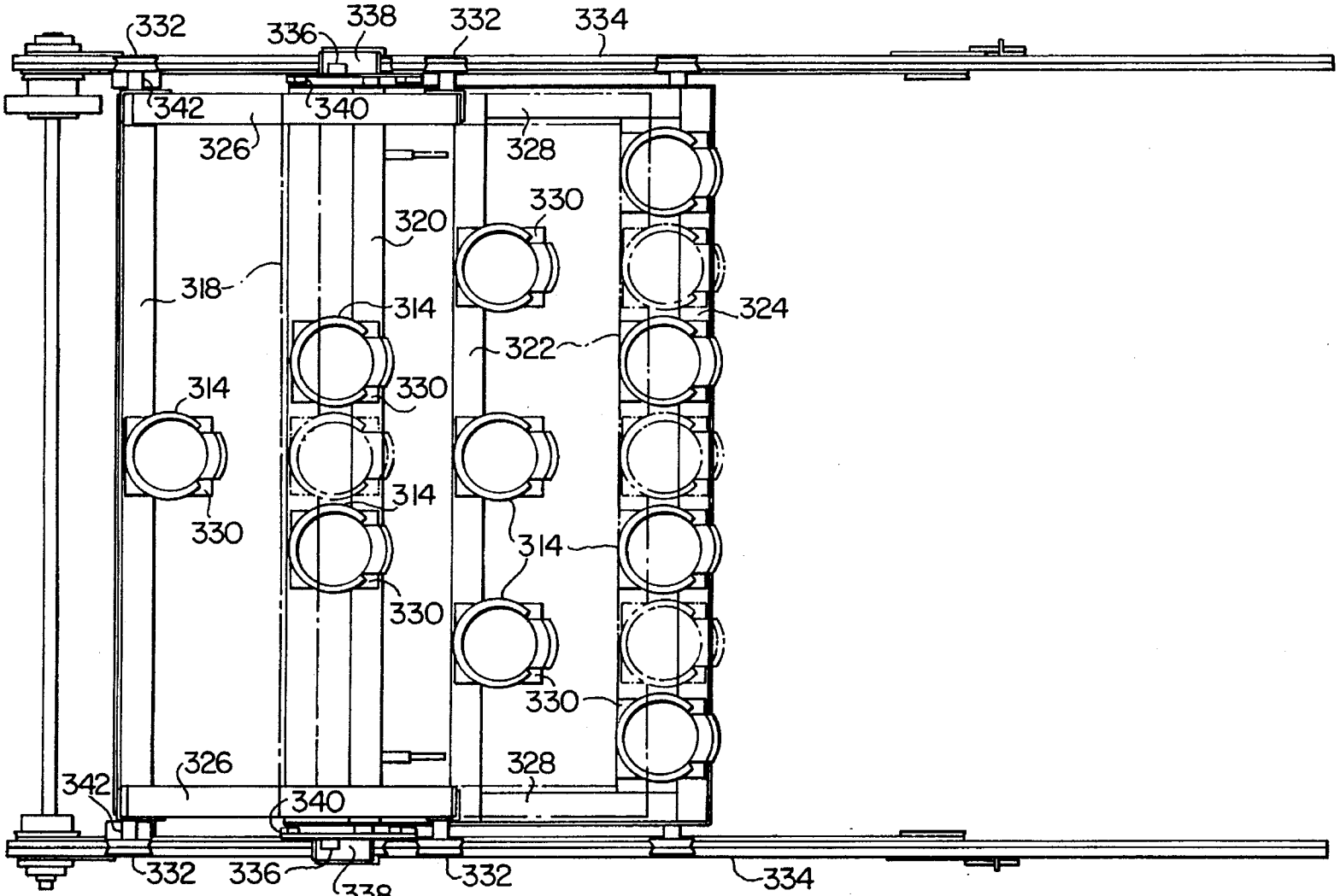
FIG. 10 is a top view of the carrier and cradles of FIGS. 6 through 9 with the carrier and cradles in the contracted condition of FIG. 9 in broken line and in the expanded condition of FIGS. 7 and 8 in full line.
Figure 11:
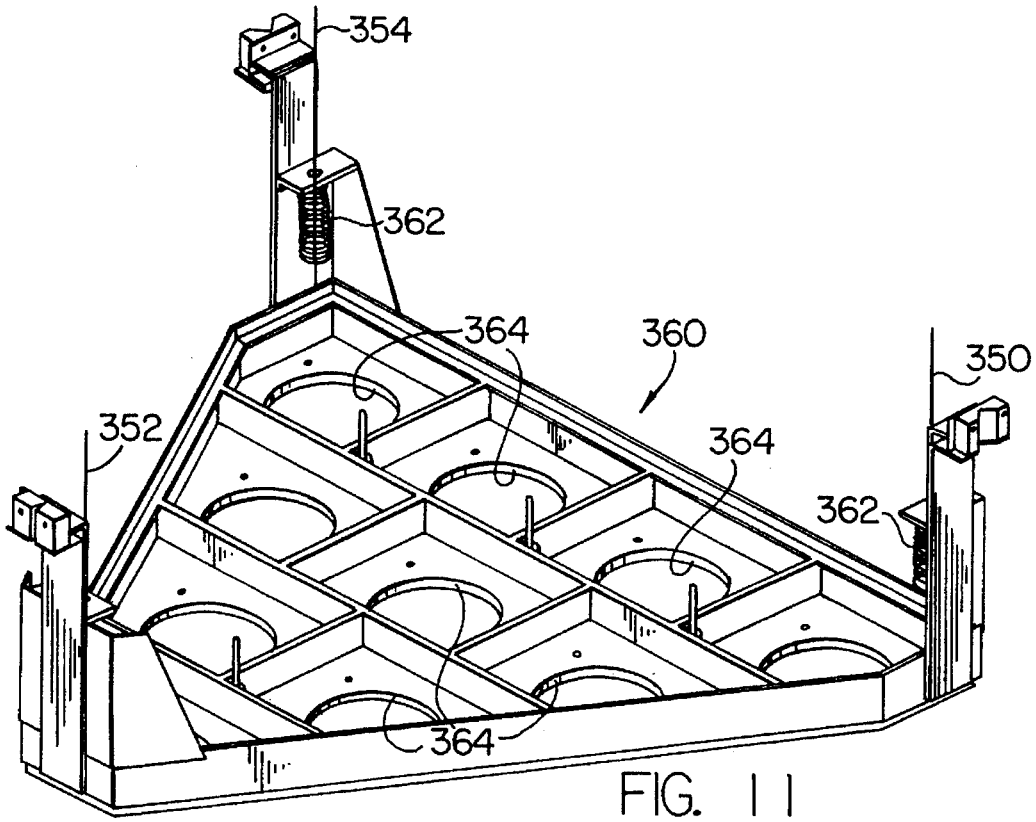
FIG. 11 is a fragmentary perspective view of the interior of a vertically moveable pinsetting mechanism and showing a plurality of small containers for holding floatable magnets.

In FIG. 10, a series of small rollers 332,332 travel along side rails 334,334 to support the slats 318–324 and their cradles 314,314 and, a pair of the rollers 336,336 serve to operate a latching mechanism. That is, the rollers 336,336 co-operate with small inclined members 338,338 on forward and rearward movement of the slats to unlatch and latch the slats 318,320. In FIG. 7 the rollers 336,336 have been raised by the inclined members 338,338 to lift small associated latches 340,340. The latches 340,340 drop into operative position to engage shaft 342 of the forwardmost rollers 332,332 as illustrated in FIG. 8 when the carrier is retracted rearwardly to the FIG. 8 position. Thus, with the latches engaged with the shaft 342, the slats 318,320,322,324 are retained in their relative position on further movement of the slats rearwardly to the position of FIG. 9. On subsequent forward movement of the forwardmost slat 318 at the urging of the lower run of the belt or chain 330, the small cam rollers 336,226 again engage the inclined members 338,338 and release the shaft 342 of the forwardmost rollers 332,332 whereby to allow full expansion of the carrier with the cradles arranged as illustrated in FIGS. 6 and 7.

The reason for the aforementioned deposit of three (3) bowling pins at the center portion of the collator 284 in the holders 286,286 of the collator will now be better appreciated. The forwardmost series of cradles in FIG. 9 including three (3) cradles as illustrated in FIG. 10 reside initially in a loading operation at the position of the cradle 314 in FIG. 3. As will be apparent actuation of the solenoids 300,300 of the three (3) centermost pin holders will result in discharge of three pins from the holders and deposit of the same in the three cradles 314,314. Subsequently, and on completion of a limited forward movement of the lower run of the chain 330 bringing the rear seven (7) cradles to the position of the front three cradles in FIG. 9, seven (7) bowling pins may be deposited in the cradles from the collator 284. In the interim, it is of course necessary to refill the three centermost holders of the collator for the discharge in unison of seven (7) pins from the collator to the seven rear cradles on the carrier.

A desired mode of operation will now be readily apparent with three (3) cradles filled from the collator 284 initially followed by the filling of the seven (7) rearwardly disposed cradles and the subsequent full forward movement and expansion of the carrier to the FIG. 6 and 7 condition. With the carrier expanded, the desired triangular array of the bowling pins on the bowling alley is simulated and it is possible for the bowling pins to be removed from their cradles in unison and in the desired arrangement by a pinsetting mechanism.

A pinsetting mechanism indicated generally at 344 in Fig. i is similar to those described in the aforementioned parent applications and is moveable vertically from a position above the carrier and cradles 314 as illustrated to cause magnets thereon to lift pins from the cradles 314. Thereafter and on rearward removal of the carrier, the pins are deposited on the bowling alley in bowling array as illustrated. Further, the pinsetting mechanism can be lowered to cause its magnets to engage the heads of one or more pins which may remain standing after a first ball has been thrown. Pins, whether "on spot" or "off spot" can then be raised to allow "deadwood" to be cleared from the alley by a sweeper not shown but which may be conventional in configuration.

Figure 15:
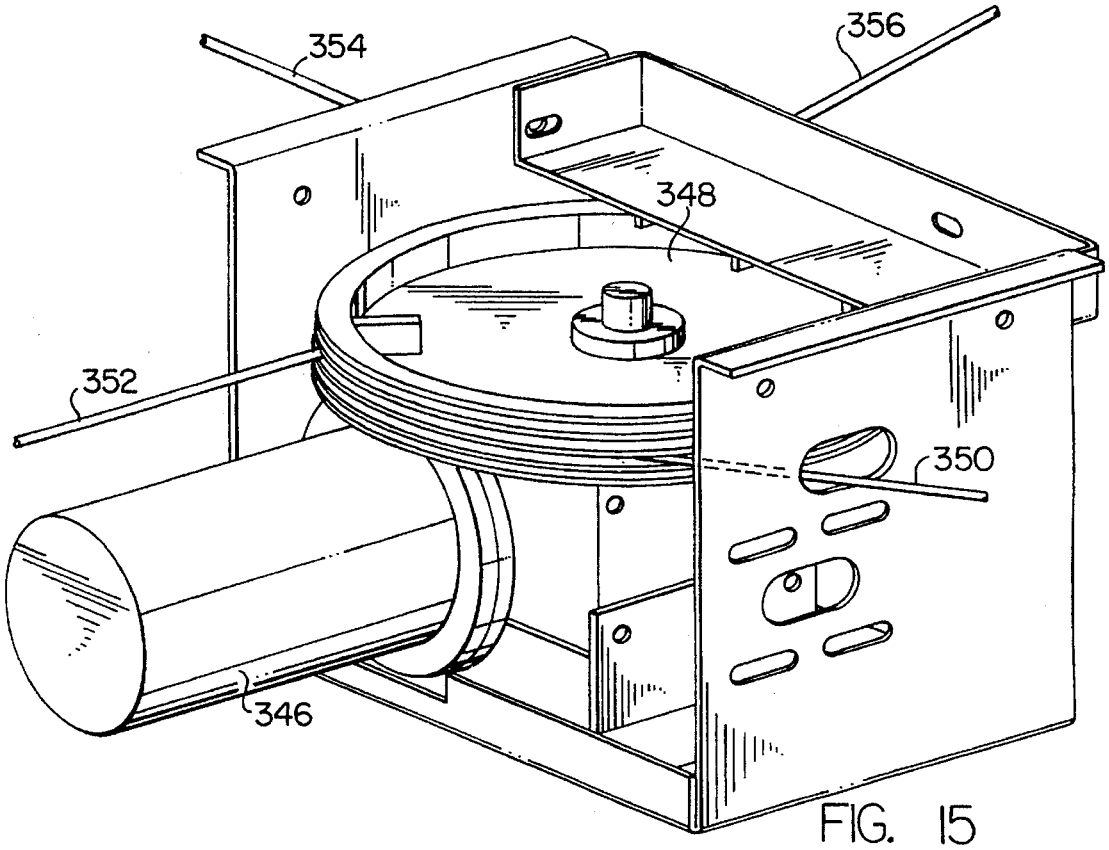
FIG. 15 is a perspective view of an electric motor and pulley forming a part of a power operating means for the pinsetting mechanism.

FIG. 15 illustrates a DC motor 346 operating a pulley 348 having three (3) lines 350,352,354 operatively associated therewith for raising and lowering the pinsetting mechanism. Preferably, a line 356 extends rearwardly to a counterweight 360 as best illustrated in FIG. 1. A suitable controller for the motor is of course provided to cooperate with an overall machine controller in the timed raising and lowering operation of the pinsetting mechanism.

Figure 12:
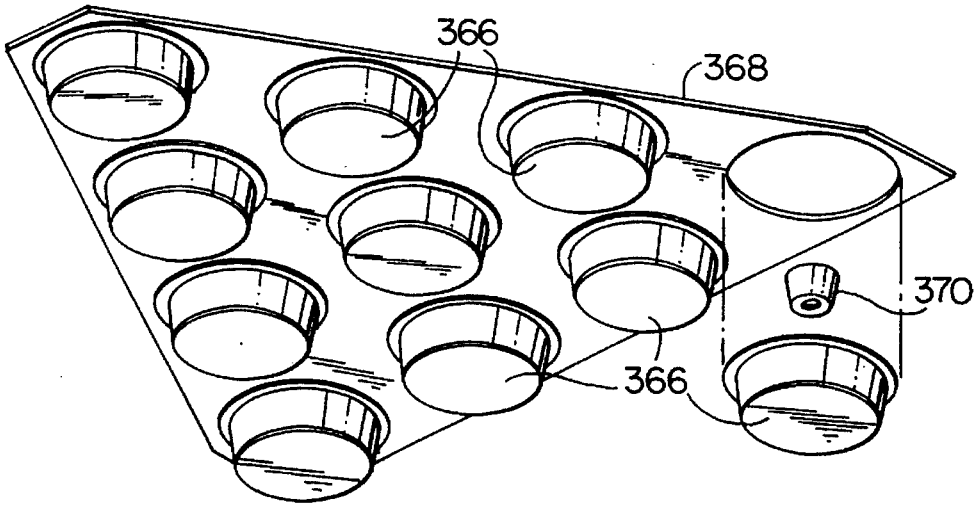
FIG. 12 is a perspective view of the pinsetting mechanism from beneath the same with the containers projecting downwardly from the mechanism.

Each of the lines 350–354 is attached to the frame by means of a relatively stiff spring 362, two shown. Ten (10) similar openings 364 arranged in triangular bowling array in the frame 360 receive ten (10) small containers 366 best illustrated in FIG. 12. As shown, the small containers 366 may be mounted on and carried collectively by a plate 368. Each of the containers 366 has a float 370 therein which carries a small permanent magnet 372 best illustrated in FIGS. 13 and 14. Further, a liquid 374 in the container causes the float to assume a normal or inoperative elevated position of FIG. 13 when the magnet 372 is spaced from a magnetically attractive material. The liquid may comprise water mixed with ordinary automotive anti-freeze.

Figure 14:
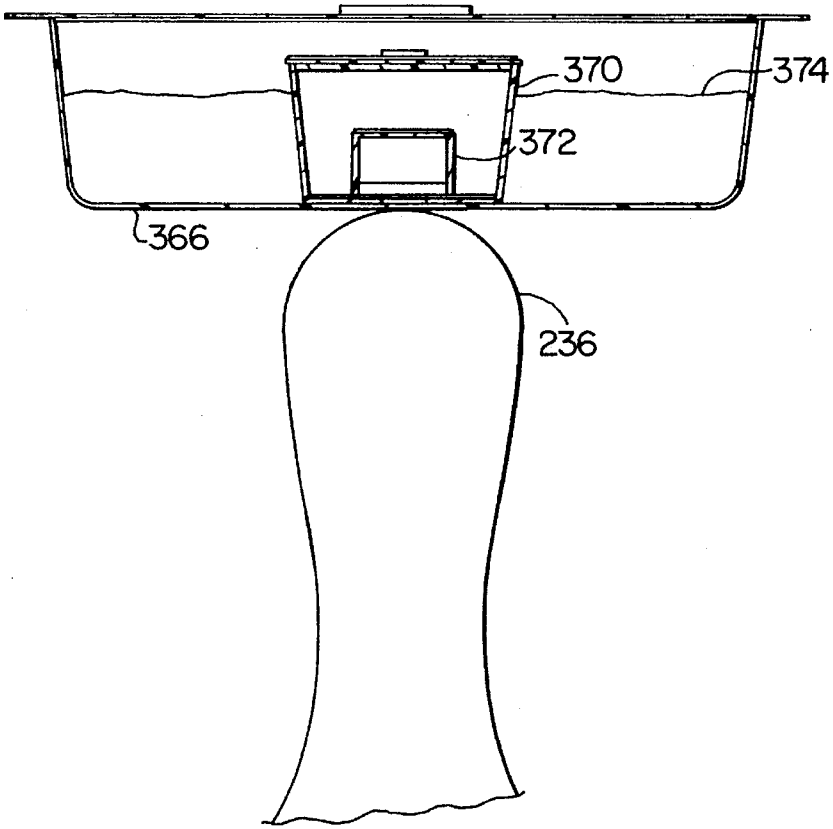
FIG. 14 is a view similar to FIG. 13 but with the head of the bowling pin engaging the bottom of the container holding the floatable magnet.
Figure 13:
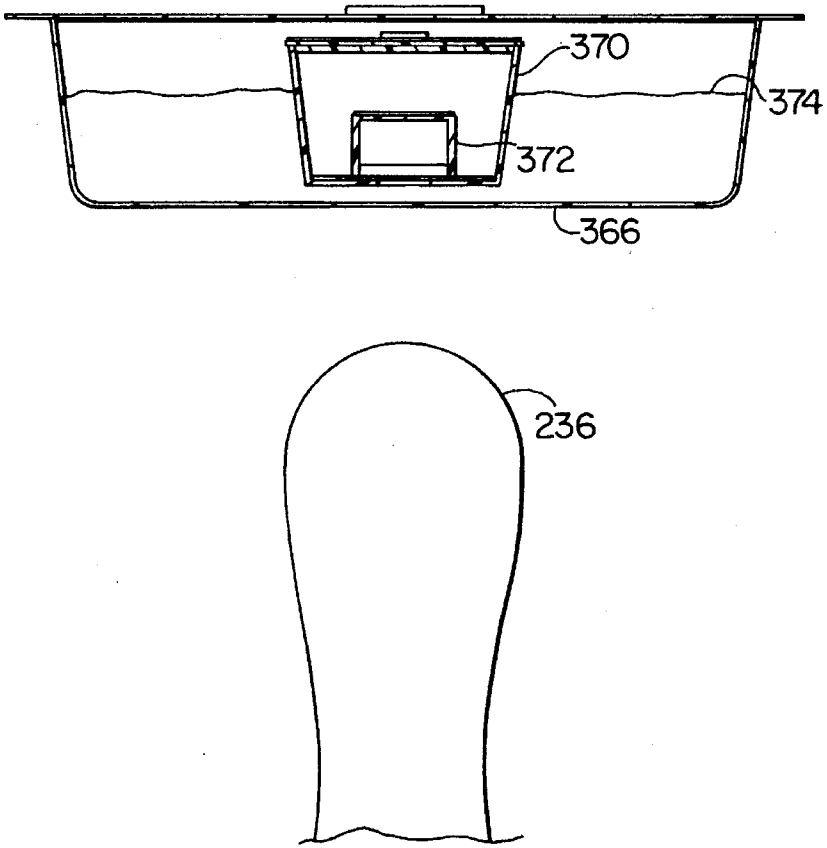
FIG. 13 is a schematic view showing a head portion of a bowling pin and an enlarged container and floatable magnet of the pinsetting mechanism, the head of the bowling pin being disposed beneath and in spaced relationship with the container.

As will be apparent, the magnet float assemblies 370,372 are capable of a limited degree of horizontal movement as required in seeking the head of a bowling pin which is in an "off spot" position on the bowling alley in a deadwood clearing operation. When a bowling pin is "on spot" or arranged in a cradle 314 as illustrated in FIGS. 13 and 14, the float 370 and its magnet 372 merely moves vertically downwardly to engage the lower wall of its container 366 whereby to exert magnetic influence and holding force on the magnetically responsive head of a bowling pin therebeneath.

The mode of attachment or pick-up of a bowling pin will now be readily apparent from the foregoing. Merely by lowering the pinsetting mechanism to an appropriate level, the bowling pins therebeneath will be engaged by the bottom walls of the containers 366 with their associated magnets 372 exerting the necessary force on the magnetically responsive bowling pin heads to effect a pick-up or attachment operation. In the simplified construction of the present embodiment, separating and other means are found unnecessary in thereafter detaching the bowling pins from the magnets and containers 366,366. That is, it has been found that a sharp upward acceleration of the pinsetting mechanism achieved by a fast start of the DC motor 346 is capable of a "snap action" release of the bowling pins. The weight and inertia of the bowling pins is sufficient to cause the bowling pins to be released or detached from the containers 366 in an efficient manner with such a rapid upward acceleration. Thus, after a carrier and cradle unloading operation and subsequent to the deposit of the pins in bowling array on the bowling alley, the pinsetting mechanism can be rapidly accelerated in its initial upward movement to cause a "snap action" release of the bowling pins. Similarly, in a deadwood clearing operation, a rapid upward acceleration of the pinsetting mechanism achieves the desired release of replaced or reset bowling pins.

Reverting now to FIG. 2, the baffle 238 is shown in its presently preferred form as a frusto-conical member but it may vary widely in configuration. In all cases, a generally circular configuration in cross-section is preferred but there may be slight deviation from the circular in the provision of a number of fiat sections which in the aggregate form a substantially circular configuration in cross-section. Similarly, a member of uniform cross-section may be provided as well as an inverted generally cone-shaped member or an inverted frusto-conical member such as the baffle 238. The baffle is preferably relatively heavy in relation to the weight of the bowling pins and in an illustrative example, the weight thereof may fall in the range of twenty (20) to thirty (30) pounds preferably twenty five (25) pounds with bowling pins weighing approximately three and one-half (3.5) pounds.

Figure 17:
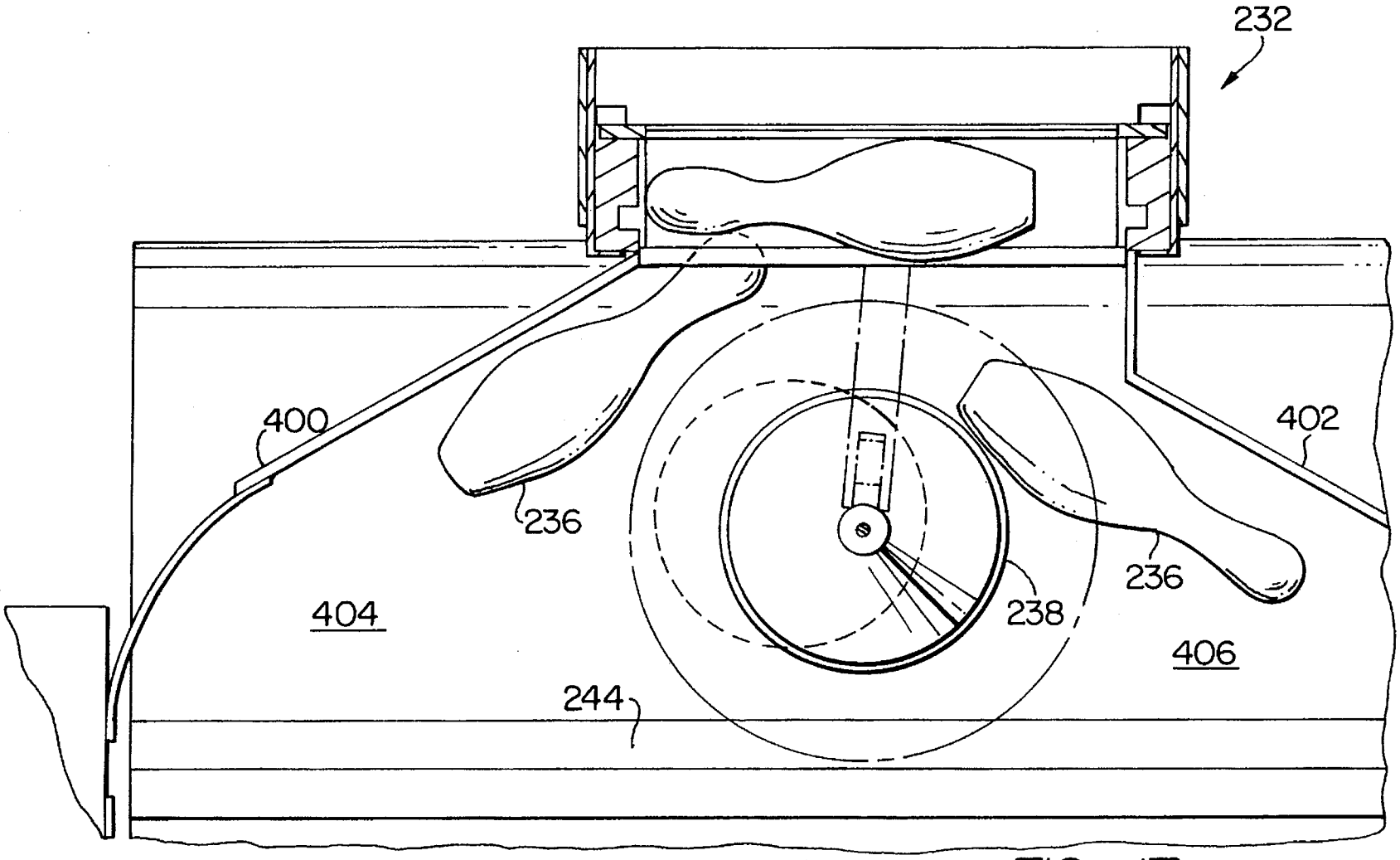
FIG. 17 is a top view of the elevator mechanism and baffle of FIGS. 2 and 16.

Partially illustrated upstanding left and fight hand guides 400 and 402 in FIG. 2 are best shown in FIG. 17. The guides 400 and 402 cooperatively direct the bowling pins rearwardly and inwardly toward the mouth or entrance of the elevator mechanism 232. Thus, the guides 400 and 402 may take the specific configuration shown in FIG. 17 wherein the guide 400 has an arcuate front end portion and a linear inwardly and rearwardly inclined rear end portion which extends directly to the elevator mechanism 232, the right hand guide 402 having a linear inwardly and rearwardly inclined front portion and a rear portion which extends directly rearwardly to the entrance of the elevator mechanism. As will be apparent in FIG. 17, the left and fight hand guides 400 and 402 cooperate with the baffle 238 to define left and right hand entry passageways 404 and 406 therebetween which are sufficiently wide for end-wise passage of bowling pins therethrough but which are insufficient in width for the side-wise passage of bowling pins. Thus, the smooth flow of pins to the entrance of the elevator mechanism is enhanced by the cooperation of the baffle 238 and the guides 400 and 402.

In FIG. 17 a left hand bowling pin is shown proceeding head first toward the entrance to the elevator mechanism and will obviously reside eventually on a shelf 234 of the mechanism with its "butt" end disposed leftwardly. Similarly, the right hand bowling pin proceeding through the right hand passageway 406 will enter a shelf 234 with its "butt" end disposed leftwardly. A reverse situation prevails when the "butt" end of a bowling pin proceeds through the passageway 401 initially with the head of the pin following and the "butt" end of the pin eventually residing at a right hand end portion of an elevator shelf 234. A bowling pin proceeding through the passageway 46 in reverse orientation to that shown will also reside eventually on a shelf with its "butt" end rightwardly disposed.

Figure 16:
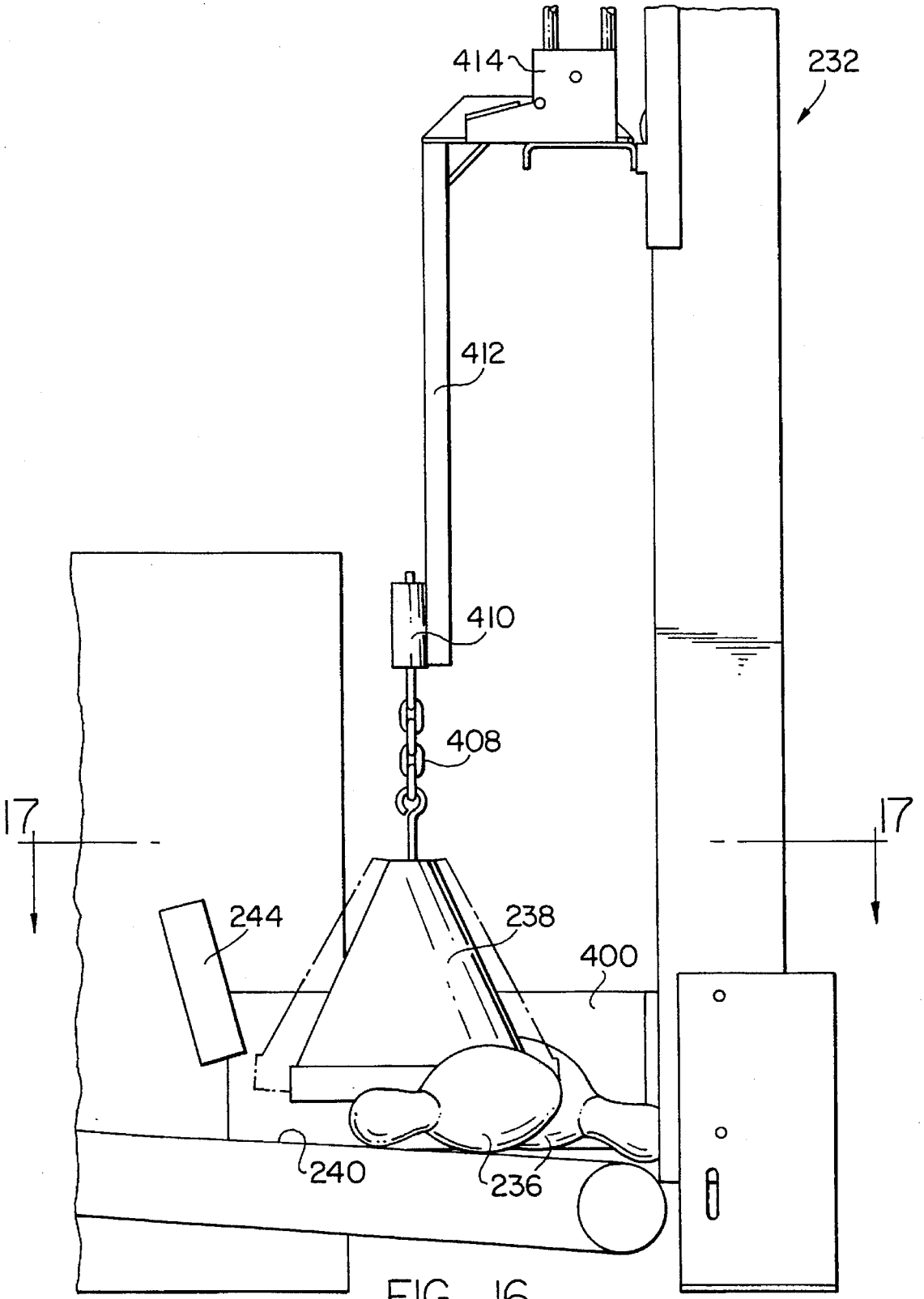
FIG. 16 is a partially schematic side view of the elevator mechanism and baffle of FIGS. 2.

Preferably the baffle 238 is mounted for limited side-to-side and front-to-rear movement and, as best illustrated in FIG. 16 suspension mounting of the baffle is presently preferred. More specifically, the baffle is mounted by means of a chain 408 depending from a shock absorber type support 410 for the chain at its upper end. Brackets 412 and 414 in turn support the chain 408 and the support 410 therefor. Thus, the baffle 238 is free to move in any direction at the urging of bowling pins in engagement therewith and the shock absorber 410 provides for quiet and efficient operation despite possible repeated jostling by the pins in movement therepast.

As will be apparent from the foregoing, a simple and yet highly efficient baffle and guide system has been provided for enhancing the efficiency of entry of bowling pins to an elevator mechanism. The design can be expected to provide for manufacture at economic advantage and for long maintenance free life in service.

I claim:

1. In combination in an automatic pinsetter; an elevator mechanism for receiving bowling pins seriatim at a lower entrance portion from a pit area at a rear end of a bowling alley and for transporting the same upwardly for discharge at an upper end portion of the mechanism, a rearwardly moving conveyor disposed forwardly of the entrance of the elevator mechanism and extending rearwardly thereto, the conveyor receiving fallen pins from a rear end portion of the bowling alley and transporting the same rearwardly in indiscriminate arrangement to the entrance of the elevator mechanism, upstanding left and right hand guides above the conveyor for co-operatively directing the pins rearwardly and inwardly toward the entrance of the elevator mechanism, and a baffle disposed above the conveyor between said guides and adjacent the entrance of the elevator mechanism, said baffle taking a generally circular configuration in cross section, and said baffle and said left and right hand guides co-operatively defining left and right hand entry passageways therebetween sufficiently wide for end-wise through passage of bowling pins but insufficient in width for side-wise pin passage.

2. The combination of claim 1 wherein said baffle is mounted for limited side-to-side movement.

3. The combination of claim 1 wherein said baffle is mounted for limited front-to-rear movement.

4. The combination of claim 1 wherein said baffle is suspension mounted from above for free limited movement in any direction.

5. The combination of claim 4 wherein said baffle is generally cone-shaped.

6. The combination of claim 5 wherein the base of the cone-shaped baffle is disposed downwardly.

7. The combination of claim 5 wherein said baffle takes an upright frusto-conical configuration.

8. The combination of claim 5 wherein said baffle is provided with a shock-absorber and suspension chain mounting.

9. The combination of claim 1 wherein said elevator mechanism is of the type including a plurality of vertically spaced forwardly open shelves each adapted to receive and hold a prone bowling pin in a sideways attitude, the shelves being equally adapted for the accommodation of bowling pins with their "butt" end portions disposed leftwardly and rightwardly.

10. The combination of claim 1 wherein a bridge is provided above the conveyor and forwardly of the baffle, the bridge being spaced above the conveyor to block upright bowling pins and bowling balls but to allow passage therebeneath of prone bowling pins.

* * * * *